United States Patent [19]

McCulloch et al.

[11] 3,959,042

[45] May 25, 1976

[54] HIGH IMPETUS, LOW FLAME TEMPERATURE, COMPOSITE PROPELLANTS AND METHOD OF MAKING

[75] Inventors: Charles R. McCulloch, Shalimar, Fla.; Robert C. Gill, White Plains, Md.

[73] Assignee: The United States of America as represented by the Secretary of the Navy, Washington, D.C.

[22] Filed: Nov. 21, 1973

[21] Appl. No.: 418,017

[52] U.S. Cl. ..... 149/19.92; 149/19.1; 149/19.91; 149/92; 149/109.6; 149/111

[51] Int. Cl.[2] ..... C06B 45/10; C06B 25/34; C06B 23/00; C06B 43/00

[58] Field of Search ..... 149/19.1, 92, 109.6, 149/111, 19.92, 19.91

[56] References Cited

UNITED STATES PATENTS

| | | | |
|---|---|---|---|
| 3,117,044 | 1/1964 | Sauer | 149/92 |
| 3,227,588 | 1/1966 | Jones | 149/92 |
| 3,296,041 | 1/1967 | Wright | 149/19.1 |
| 3,449,179 | 6/1969 | Minekawa | 149/92 |
| 3,652,350 | 3/1972 | Timmermans | 149/19.3 X |
| 3,834,957 | 9/1974 | McDevitt | 149/92 |

*Primary Examiner*—Benjamin R. Padgett
*Assistant Examiner*—Donald P. Walsh

[57] ABSTRACT

High impetus, low flame temperature propellants are produced by the incorporation of a polynitramine into a saturated polymer of a lower hydrocarbon.

1 Claim, No Drawings

HIGH IMPETUS, LOW FLAME TEMPERATURE, COMPOSITE PROPELLANTS AND METHOD OF MAKING

BACKGROUND OF THE INVENTION

This invention relates to a propellant and a method of making a propellant and more particularly to a composite propellant having a high impetus and low flame temperature and method of making a composite propellant.

In minimal weight rapid fire cannon an acceptable gun propellant should deliver an impetus of $3.8 \times 10^5$ ft lb/lb with a flame temperature less than 2,600°K. Current double base gun propellants are characterized by a relatively low impetus (3.0 to $3.5 \times 10^5$) ft lb/lb and high flame temperature (3,000° to 4,200°K). In rapid fire cannon the high flame temperatures compromise barrel life. Efforts to decrease barrel errosion by lowering flame temperatures have been affected only by lowering impetus. Alternate routes to increased impetus by increasing a propellant charge or pressure are self-abnegating in that the overall weight of the gun is increased. Composite gun propellants utilizing liquid or free flowing binders have the following disadvantages (a) the hydrogen content is relatively low which impairs impetus (b) the extruded grains have no dimensional stability and (c) retention of grain configuration is difficult during curing.

Also adding components to a propellant to achieve desired properties requires additional processing of the material. Adding of the various components to the propellant must be accomplished by a relatively simple method in order to make the component to be added an even more desirable additive.

SUMMARY OF THE INVENTION

It is therefore, an object of this invention to produce a gun propellant having a high impetus.

It is a further object of this invention to provide a propellant which increases gun barrel life.

It is a still further object of this invention to provide a propellant which leads to increased gun barrel life by lowering flame temperature of the propellant.

It is a further object of this invention to provide a propellant which has increased gas production while attaining lowered flame temperatures.

It is also an object of this invention to provide a propellant which maintains high impetus without increasing propellant charge or pressure.

It is a further object of this invention to provide a method for making a propellant having a high impetus and a low flame temperature.

These and other objects of the invention are attained by a propellant produced by adding an oxidizer to a solution of a polymer and precipitating the polymer to thereby incorporate the oxidizer in the polymer and to form a high impetus low flame temperature composite propellant.

DESCRIPTION OF THE PREFERRED EMBODIMENTS

It has now been found that incorporation of polynitramine explosives in a polymeric binder reduces flame temperature of the propellant while maintaining high impetus due to increased gas production.

Accordingly, a polymeric binder is dissolved in an organic solvent to form a solution. Then a polynitramine is incorporated in the solution. An organic liquid is added to precipitate the polymer and form a propellant.

Suitable polymeric binders are selected from the group consisting of polyethylene and polypropylene. Up to 60% of the total binder can be composed of polyisobutylene. Thus a polyethylene polyisobutylene or a polypropylene polyisobutylene combination makes a suitable binder. The polyisobutylene renders the polyethylene or the polypropylene more suitable as a binder.

Suitable polynitramines, which are incorporated in the binder include cyclotetramethylenetetranitramine (hereafter HMX) a cyclotrimethylenetrinitramine (hereafter RDX) in the 10–20 micron particle size range. The $\beta$ form of HMX is used in propellants. The polynitramines serve as the oxidizer in the propellants. About 75 to 90% by weight of the propellant is the oxidizer. It follows that 10 to 25% by weight of the propellant is binder. A more suitable amount of oxidizer is 82–89% by weight of the propellant. The preferred amount of oxidizer is 84–87% by weight of the propellant and the preferred amount of binder is 13 to 16% by weight of the propellant.

Solvents suitable for carrying out the method are heptane and hexane. These solvents dissolve the binder and have no adverse effects on the HMX or RDX which is added to the binder solution. About 0 to 80% by weight of the solvent can be toluene. Thus, a toluene and heptane, or a toluene and hexane solvent combination can be used as a solvent in addition to heptane alone or hexane alone. Precipitation of the binder with the oxidizer incorporated therein results upon the addition of alcohol. Suitable alcohols are ethanol and methanol.

Additionally comonomers may be included in the polyethylene or polypropylene in order to provide functional groups such as carboxylic (—COOH) or hydroxy (—OH) which aid the curing of the polymeric binder. With these functional groups in the polymer, a suitable crosslinking or curing agent may be added to cure the propellant.

Coolants and coolant-oxidizers can also be added to the propellant to further reduce the flame temperature. Suitable coolants include diammonium succinate, dimethyl ammonium oxalate, and polyformaldehyde. About 0 to 10% by weight of the propellant of these coolants may be present in the composition. Typical coolant-oxidizers include trimethyl amine and tetramethylamine nitrate salts. About 8% of the coolant is suitable, based on the weight of the propellant. About 0 to 10% of coolant-oxidizer based on the weight of the propellant is suitable.

Polymers having molecular weights of up to about 100,000 are suitable for the purpose of this invention so long as the polymers meet the other criteria.

The following examples are intended only to illustrate the claimed invention, and not to limit the scope of the invention. All parts and percentages are by weight unless otherwise stated.

EXAMPLE 1

About 8.4 grams of HMX having a particle size of 15 microns is incorporated into a solution having heptane as the solvent and 0.8 grams of polyisobutylene and 0.8 grams of polyethylene as a solute by mixing. Ethanol is added to completely precipitate the polyisobutylene and polyethylene with HMX incorporated therein. Excess liquid is decanted and the resultant precipitate is dried. The form of the precipitate is blocked crumbs, which can be molded, extruded or otherwise shaped to a useful propellant. Theoretically, the resultant propellant has an impetus of $3.8 \times 10^5$ foot pounds per pound, a flame temperature of 2530°K, and gas production of 5.4 moles per 100 grams of propellant.

EXAMPLE II

The procedure of Example I is repeated with a 75% oxidizer and 25% binder propellant being produced. The resulting propellant also has the desired properties.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. A method for making a high-impetus, low flame temperature composite propellant comprising 10 to 25% of a saturated polymer of a lower hydrocarbon, and 75 to 90% of a polynitramine which comprises a. dissolving the polymer in a hexane or heptane solvent together with 0–80% toluene by weight of solvent to form a solution;

b. adding the polynitramine to the solution;

c. adding methanol or ethanol to the solution to precipitate the high-impetus low flame temperature propellant;

d. decanting the excess solution e. drying the propellant.

* * * * *